US005438315A

United States Patent [19]

Nix

[11] Patent Number: 5,438,315

[45] Date of Patent: Aug. 1, 1995

[54] SECURITY ALARM SYSTEM

[76] Inventor: Ronald D. Nix, Rte. 1, Box 285K, Nevada, Tex. 75173

[21] Appl. No.: 311,706

[22] Filed: Sep. 23, 1994

Related U.S. Application Data

[63] Continuation of Ser. No. 8,199, Jan. 25, 1993, abandoned.

[51] Int. Cl.[6] ..... G08B 3/10

[52] U.S. Cl. ..... 340/539; 340/574; 200/DIG. 2

[58] Field of Search ..... 340/427, 432, 539, 574, 340/573, 693; 455/348, 349; 200/43.01, 330, 331, 333, DIG. 2

[56] References Cited

U.S. PATENT DOCUMENTS

| | | | |
|---|---|---|---|
| 4,057,794 | 11/1977 | Grossfield | 200/333 |
| 4,158,197 | 6/1979 | Tagagaki | 340/574 |
| 4,455,548 | 6/1984 | Burnett | 340/573 |
| 4,587,516 | 5/1986 | Hiraki | 340/539 |
| 4,591,836 | 5/1986 | Feigenblatt | 340/539 |
| 4,667,188 | 5/1987 | Schwartz | 340/574 |
| 4,694,284 | 9/1987 | Leveille et al. | 340/539 |
| 5,001,462 | 3/1991 | Seeman | 340/574 |
| 5,005,002 | 4/1991 | Halperin | 340/693 |
| 5,025,247 | 6/1991 | Banks | 340/574 |
| 5,032,823 | 7/1991 | Bower et al. | 340/539 |
| 5,196,829 | 3/1993 | Janis | 340/574 |
| 5,218,344 | 6/1993 | Ricketts | 340/539 |
| 5,235,322 | 8/1993 | Obysovsky et al. | 340/574 |

*Primary Examiner*—Jeffery A. Hofsass
*Assistant Examiner*—Daniel J. Wu
*Attorney, Agent, or Firm*—Dennis T. Griggs

[57] ABSTRACT

A security alarm system having a transmitting unit adapted to be worn as a bracelet, and a remote alarm unit. The transmitting unit is preferably in the form of a bracelet having a cavity enclosing an rf transmitter operable to transmit encoded signals to the remote unit for actuating an audible alarm.

1 Claim, 2 Drawing Sheets

SECURITY ALARM SYSTEM

This continuation of application Ser. No. 08/088,199 filed on Jan. 25, 1993 abandoned.

FIELD OF THE INVENTION

This invention relates to security alarm systems and, more particularly, to a security system having a remotely actuable alarm unit.

1. Background of the Invention

Assaults and other criminal activities are of increasing concern in many areas, and various security systems have been devised for providing protection against such criminal activities. It has thus been attempted to provide alarm systems which can be conveniently actuated in the event of an emergency such as an assault for attracting attention to the incident and possibly intimidating and driving off the assailant. Because the victim of an assault may be surprised and possibly overpowered by the assailant, it is critical that such an alarm system is adapted to be quickly and conveniently actuated by the victim. It is equally important that the sound of the alarm be of sufficient intensity and coverage to intimidate the assailant and to bring the emergency to the attention of security personnel or persons near the area who may be able to provide assistance. Examples of such emergency situations include an assault upon a victim walking through a parking lot at a shopping center or the like, or walking to a car in a dimly lit neighborhood, or a person surprised by an intruder in a home or business. The possibility of such an assault is of particular concern to women, children, the elderly and those who suffer from various physical disabilities. For example, women who are required to traverse hazardous areas, or who live in neighborhoods subject to criminal activity, may suffer from a level of anxiety not fully appreciated by those who are not routinely subject to such dangers, and their concerns may result in their being forced to accept undesirable limitations in their normal activities.

2. Background of the Prior Art

In the development of security alarms for use in such emergencies, it has been sought to provide portable alarmunits which can be carried on the person or in a handbag or the like for emitting an audible alarm to alert passersby or security personnel. Such portable alarms are typically self-contained units which include a siren, buzzer, bell, or other sound generating unit which is activated in the event of an emergency by closing a switch on the unit to provide power to the alarm. Self-contained units are thus typically miniaturized, battery-powered units, small enough to be carried in a purse or pocket or supported by a chain or other attachment means.

Whereas such self-contained units provide the advantages of convenience and portability, they typically do not have sufficient power to emit an audible alarm of sufficient intensity to intimidate an assailant or attract the attention of persons remote from the victim, such as persons located across a parking lot. Further, they are ineffective in an area in which background noises, such as those caused by traffic, tend to obscure the sound of the alarm. Additionally, during an assault, such portable units may be removed by the assailant and destroyed or disabled. Alternatively, if the self-contained units are constructed with more powerful batteries and alarm devices, they tend to be excessively large and heavy, and users tend not to be willing to carry heavy or large units on their person.

It can thus be seen that such portable, self-contained alarm units entail a number of limitations and disadvantages. Accordingly, a second class of alarm systems, termed herein "remotely actuated" systems, has been devised. In such a remotely actuated system, an alarm unit of substantial size and power may be employed which is activated by means of a second, portable unit which may be lightweight and of compact size, permitting its convenient transport by a wearer. In at least one such system, the actuating unit includes a radio frequency or infrared transmitter, and the alarm unit has a receiver responsive to such signals, whereby the alarmunit may be actuated by a signal generated by the portable unit. Such a remotely actuable system thus permits the use of an alarm unit of sufficient power to emit an audible alarm of high intensity, whereas the transmitting unit may be constructed as a smaller, conveniently portable unit.

A major difficulty tending to prevent adequate and timely response to assaults and other criminal activities is the element of surprise and the fact that an assailant may quickly remove the victim's purse or other belongings and thereby obtain possession of a transmitter, or self-contained alarm unit, prior to its activation by the victim. Typically, the victim may be confused and/or disabled during an assault and thus unable to locate a transmitting unit quickly and to engage its triggering switch, for activating the alarm. Therefore, it is of importance that the transmitting unit be conveniently accessible to the user, whereby it may be readily actuated at the first sign of danger. It is thus preferable that the unit not be carried in a purse or pocket, from which it is difficult to retrieve. Another important factor is that the transmitting unit should have sufficient power to activate the receiving unit reliably from an adequate distance. For example, in one application of the present invention, a receiving unit and associated alarm is installed in a vehicle and powered by 12-volt power from the vehicle's battery. In such an application, the transmitting unit is preferably of sufficient size and power to actuate the receiving unit from a substantial distance, e.g., 100–150 feet or more.

In one prior-art concept, it has been proposed to mount a transmitting unit in a simulated "stone" in a ring worn by a potential victim. However, the transmitting power of such a miniaturized transmitting device, which necessarily includes a battery, transmitting switch, oscillator and transmitter circuit, antenna, and connecting circuitry, is undesirably low, and such systems have not enjoyed widespread popularity.

OBJECTS OF THE INVENTION

It is, accordingly, a major object of the present invention to provide a new and improved security alarm system.

Another object is to provide a new and improved security alarm system of the type having separate receiving and transmitting units, whereby the transmitting unit may be conveniently carried by a user.

Yet another object is to provide such a security alarm system in which the transmitting unit is mounted within a bracelet adapted to be worn on the wrist of a user.

Yet another object is to provide such an alarm system in which the bracelet is of sufficient size to contain a switch, a power supply, an effective and reliable radio frequency transmitter, and an antenna, and wherein the transmitting unit is reliably operable to transmit an rf signal over a substantial distance.

A further object is to provide such a system in which the bracelet is of a particular construction effective both for preventing removal or destruction of the bracelet in the event of an assault and for facilitating rapid actuation of the alarm unit in an emergency, yet which nevertheless is substantially immune to false alarms caused by inadvertent or accidental manipulation of the switch.

A still further object is to provide such an alarm system in which the remote unit may be conveniently installed in a vehicle and powered by the battery of such a vehicle or, in a home installation, provided with a power supply derived from utility service 115 VAC power.

A further and related object is to provide such an alarm system in which the remote unit is actuable upon receiving an encoded pulse from the transmitting unit and wherein an audible or visible alarm within the remote unit remains operable until the unit is deactivated, or for a predetermined period of time subsequent to receipt of the actuating signal.

Other objects and advantages will become apparent from the specification and accompanying claims and from the accompany drawing.

SUMMARY OF THE INVENTION

In accordance with one preferred embodiment of the invention, a radio frequency transmitting system is contained within a bracelet formed of a rigid material, the transmitting unit including a normally open switch connected in series between a power supply and a transmitter which suitably is adapted to transmit encoded rf signals, a transmitting antenna being provided which extends along a portion of the bracelet. In one preferred embodiment, the bracelet has first and second hinged segments which are releasably connectable at their respective distal end portions by means of a security latching mechanism, and in which a switching element is located in a portion of the bracelet spaced from the security latching mechanism. The remote unit is provided with a power supply and a receiving unit for receiving and decoding the rf transmissions, the receiving unit having a monostable or latching switch for closing a circuit between a power supply and a noise generating device and for maintaining such a closed circuit until reset by an operator, or for a desired time subsequent to receipt of the rf signal.

BRIEF DESCRIPTION OF THE DRAWING

For a more complete understanding of the invention, reference should be made to the accompanying drawings, wherein.

DETAILED DESCRIPTION OF THE INVENTION

Figure 1:
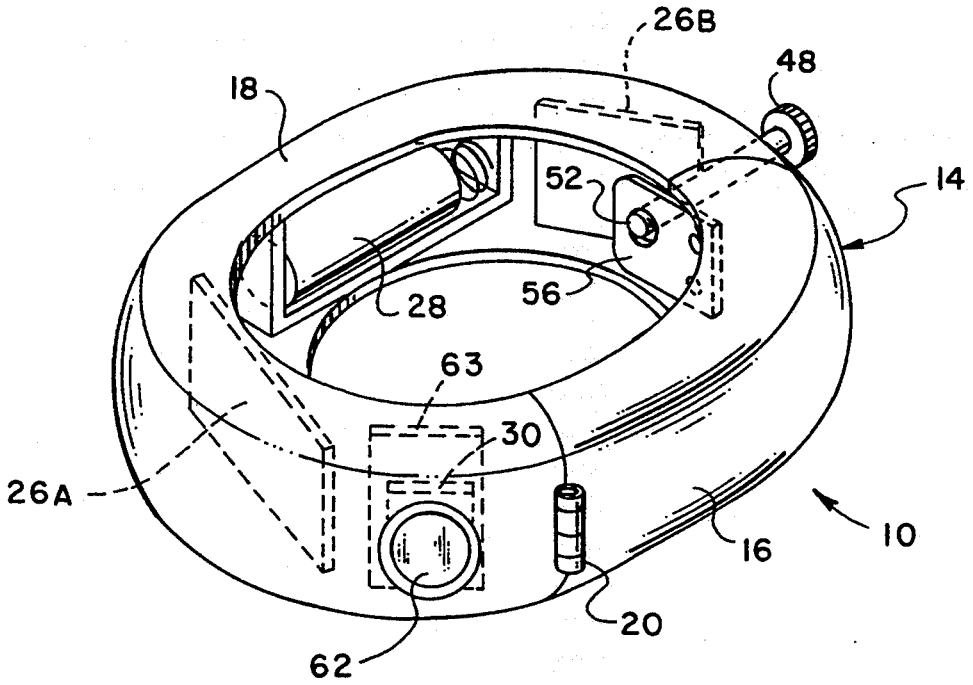
FIG. 1 is a perspective view of the transmitting unit of one preferred embodiment of the present invention.
Figure 5A:
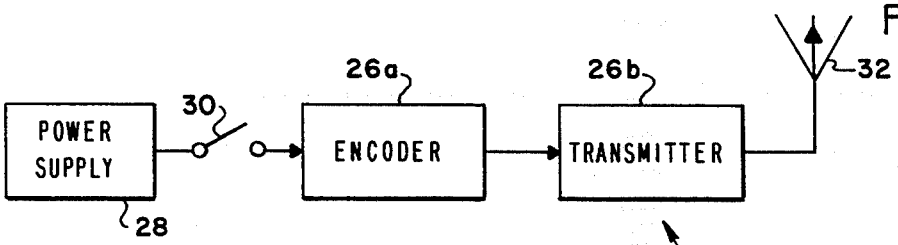
FIG. 5*a* is a block diagram of the transmitting system.
Figure 5B:
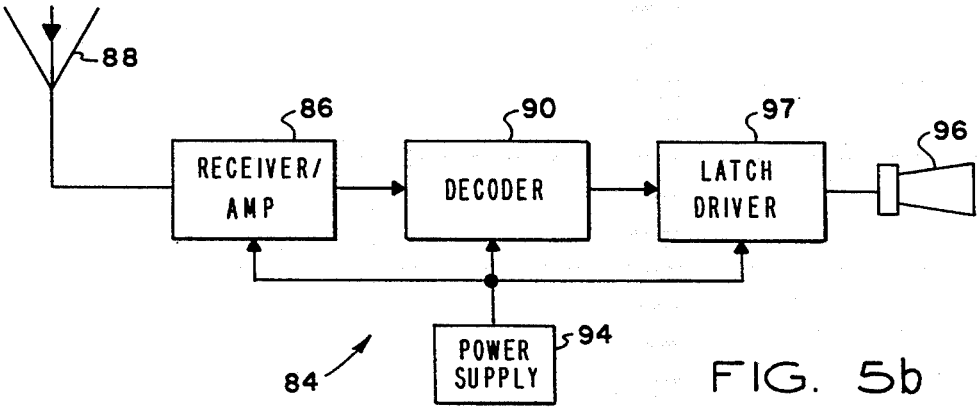
FIG. 5*b* is a diagrammatic representation of the remote, receiving unit showing the noise generating unit in pictorial form.

The alarm system of the present invention includes a transmitting unit 10 (FIGS. 1–3), the circuit of which being represented diagrammatically in FIG. 5*a*, and a receiving unit 12, represented diagrammatically in FIG. 5*b*. With initial reference to FIGS. 1 and 2, the transmitting unit 10 includes a housing in the form of a bracelet 14 adapted to be worn upon the wrist, whereby it is conveniently accessible to the wearer in the event of an emergency. In the illustrated embodiment, the bracelet 14 is a bangle-type bracelet formed of a rigid material such as an injectable or moldable plastic. The bracelet 14 is divided into first and second segments 16, 18 which are hinged together at their proximate end portions by hinge structure 20, the segments 16 and 18 having respective first and second, mutually confronting, distal end portions 22, 24 (FIG. 3). The bracelet 14 is advantageously of substantially oval or elliptical configuration in plan, as seen in FIG. 3, and its inner diameter is sufficiently small that, when the bracelet is in its closed or latched orientation, it may not be removed from the wrist of the wearer.

Figure 2:
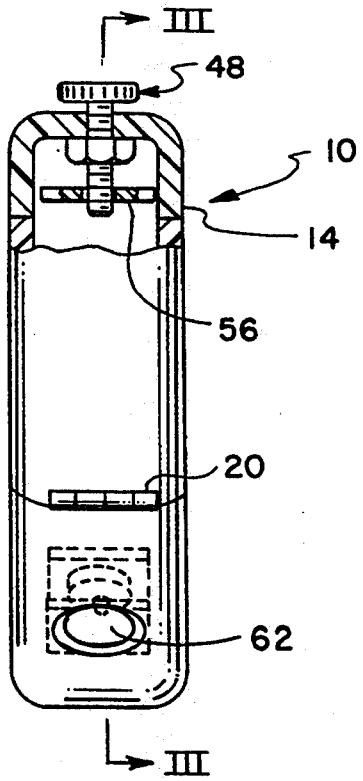
FIG. 2 is a side view, partially broken away, of the transmitting unit of FIG. 1.
Figure 3:
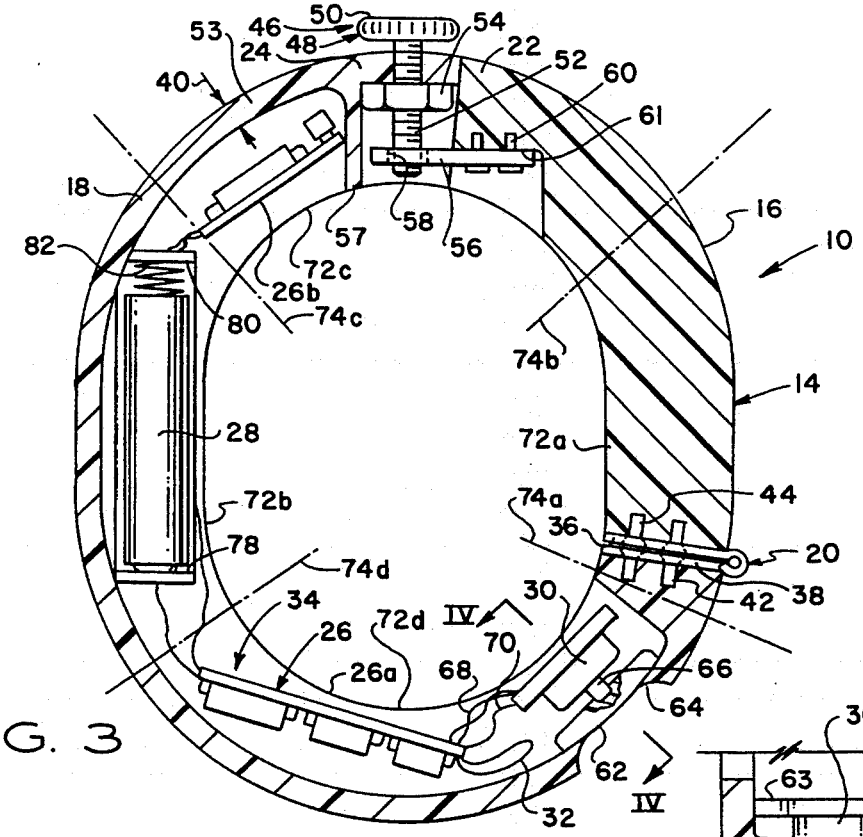
FIG. 3 is a sectional view taken as on line III—III of FIG. 2.

The bracelet 14 of the embodiment of FIGS. 1–4 is thus constructed as a bangle-type bracelet of generally oval or elliptical configuration in plan, and the second segment 18 is of generally U-shaped local cross section, as shown in FIG. 2, whereby the outer surface is of convex curvature in cross section, and wherein the inner surface defines a cavity, extending along the length of the second segment 18, for receiving electrical components including a radio frequency transmitter and encoder 26, one or more batteries 28, a normally open switch assembly 30, and a transmitting antenna 32, which together constitute a radio frequency transmitting system 34, to be described in greater detail hereinbelow with reference to FIG. 5*a*. In the present embodiment, the transmitting system 34 is contained within the second bracelet segment 18, whereby it is not necessary to provide flexible leads connecting components mounted in the two segments.

The bracelet segments 16, 18 are pivotally interconnected by a hinge structure 20 for permitting outward pivotal movement of the segments 16, 18 when it is desired to remove the bracelet. The hinge structure 20 includes a first hinge plate 36 which extends transversely across the proximate end portion of the first bracelet segment 16, which in the present embodiment is of solid rather than hollow or U-shaped configuration, and a second hinge plate 38 which extends across the proximate end portion of the second bracelet segment 18.

Thus, the bracelet 14, in the preferred embodiment, is of smoothly contoured configuration providing the appearance of a bangle worn for ornamentation, and its function as part of a security alarm system is not readily apparent, since the transmitter system 34 is concealed within the bracelet. Accordingly, an assailant normally would not be aware that the intended victim was wearing a security alarm transmitter. Additionally, the bracelet 16 preferably is of rugged and durable construction whereby it may not readily be removed from the wrist of the wearer during an assault or accident as would be the case with an item of jewelry or the like. More specifically, the bracelet 14 is preferably constructed of a durable and rigid plastic, and it has a minimum wall thickness 40 (FIG. 3) of about 1/16 inch, and more preferably, ⅛ inch. Additionally, the hinge plates 36 and 38 are rigidly and securely fastened to the first and second bracelet segments 16, 18, respectively, suitably by means of an epoxy adhesive and additionally by pins 42 driven into the inner surface of the second bracelet segment 18, and pins 44 driven into the proximate end portion of the first bracelet segment 16.

The distal end portions 22, 24 of the first and second bracelet segments 16, 18 are releasably connectable by means of a security latching mechanism 46 which, in the preferred embodiment, is a screw-type latching structure. The latching structure 46 of the present embodiment comprises a thumbscrew 48 having a head portion 50 and a threaded shank 52 which extends radially inwardly through the outer surface of the bracelet 14. In the present embodiment, the shank extends through a corresponding bore formed perpendicularly through outer, peripheral wall portion 53 in the distal end portion 24 of the second segment 18. Preferably, a retaining member, such as nut 54, having an internally threaded opening, is provided for engaging the threaded shank 52, the nut 54 being secured to the outer bracelet wall 53 suitably by means of an epoxy adhesive, and preferably being embedded within the outer wall 53. The nut 54 and the bore formed through the wall are thus coaxially aligned along a transverse axis extending perpendicularly of the outer wall and radially relative to the bracelet. With additional reference to FIG. 1, the shaft 52 of thumb screw 48, when threadingly engaged with and extending through the nut 54, extends within and is lockingly engaged with a retaining member 56. Retaining member 56 is suitably a rigid metal plate affixed to the first bracelet segment 16, within the distal end portion 22, and having a projecting portion having an opening 58 (FIG. 3) for receiving the threaded shank 52, whereby the distal end portions 22, 24 of bracelet segments 16, 18 are releasably engaged and securely locked together. The retaining or latch member 56 is rigidly secured to the inner surface of the distal end portion 22 of first bracelet segment 16 by means of an epoxy adhesive and also by pins 60 which are driven through corresponding bores within the latch member 56 and embedded within inner wall portion 61 of first bracelet segment 16. The first bracelet segment 16 is advantageously reinforced by being of thicker, solid construction. The second bracelet segment 18 is further reinforced by end wall 57 which extends laterally across the second segment adjacent distal end portion 24.

Accordingly, it may be seen that the latching mechanism 46 is a security latching mechanism, whereby the segments 16 and 18 may be securely engaged and whereby the bracelet 14 may not readily be unlatched or broken during an assault or scuffle. In contrast to the ornamental and clasp-type latch mechanisms commonly used in conventional bracelets worn exclusively as jewelry, the latch mechanism 46 may not be quickly unlocked or broken. Instead, the thumb screw 48 must be withdrawn by rotating it counterclockwise through several revolutions to withdraw the shank 52 from the latch member 56. Additionally, the latching structure 48 is of rugged construction, suitably formed of steel or nickel alloy components, rather than of an alloy of gold or silver as in many jewelry items. However, as indicated above, the head portion 50 may suitably be of an ornamental configuration and color for further enhancing the appearance of the bracelet 14. Thus, the ornamental appearance of the preferred embodiment of the bracelet serves the utilitarian function of effectively camouflaging the transmitting unit 10, whereby a potential assailant is unaware of its security application until the alarm is actuated.

Figure 4:
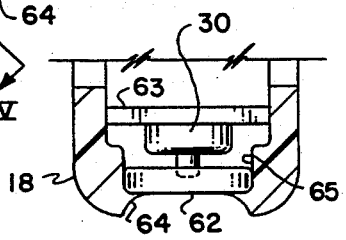
FIG. 4 is a sectional view taken as on line IV—IV of FIG. 3.

The normally open switch 30, as seen most clearly in FIGS. 3 and 4 and as represented in diagrammatic form in the electrical diagram of FIG. 5*a*, is preferably a push button actuated type having a resiliently depressible, switch activating push button member 62 which is preferably formed of a plastic material of the same color as the bracelet segments 16, 18. The switch 30 is suitably affixed, within the second bracelet segment 18, below and in alignment with an inwardly tapered opening 64 formed through the outer peripheral wall portion 53, the push button 62 suitably being of square or rectangular configuration in plan, and having lateral dimensions greater than the inner diameter of the opening 64. The push button 62 is urged outwardly against the outer wall 53 of the second segment 18 by means of outwardly resiliently biased push rod or triggering member 66 (FIG. 3), the distal end of which is suitably embedded within the button 62. As seen in FIG. 4, the cross-sectional configuration of the segment 18 adjacent the switch 30 may suitably be of a stepped configuration, defining vertical, planar inner side surfaces 65 for constraining and guiding the button 62 as it is depressed or released. The board 63 supporting switch 30 is suitably affixed by a suitable adhesive between the sidewalls of bracelet segment 18. Such resiliently biased, normally open switches 30 are readily available as commercial items. In the preferred embodiment, as seen in FIG. 3, the button 62 is formed with a convex outer curvature, following the curvature of the peripheral outer surface of the bracelet segment 18, for enhancing the ornamental appearance of the bracelet and facilitating depression of the button by the wearer. The button 62 is always recessed below the outer surface of the bracelet 14, and it will therefore not be inadvertently depressed by the wearer. Additionally, because it is recessed within the tapered opening 64, and is continuous with and formed of the same material and color as the bracelet itself, the push button is inconspicuous, further enhancing the illusion that the bracelet is merely an ornamental item rather than a security instrument.

The normally open switch 30 is connected, as by leads 68 and 70, between the transmitter/encoder 26 and the terminals of battery 28. In the illustrated embodiment, the transmitter and encoder circuit is formed on first and second printed circuit boards 26*a*, 26*b*, whereby the transmitter 26 and battery 28 are extended along the length of the curved, second bracelet segment 18. In other embodiments, however, the transmitter circuit is suitably formed as a single, integrated or surface-mounted circuit (not shown). Antenna 32 suitably extends partially along the length of the second bracelet segment 18. The construction and operation of the transmitting system 34 and the receiving unit 12 will be further described hereinbelow.

With reference to FIG. 3, it should be further noted that the physical arrangement of the components of the transmitting unit 10, including the latching mechanism 46, the transmitter/encoder 34, and the push button 62, are advantageously arranged to permit convenient operation of the transmitter in the event of an emergency. For clarity and convenience of description, the bracelet 14 may be considered as having a lower portion 72*a* adapted to extend beneath the wrist of a wearer, an upper portion 72*b* adapted to extend over the wrist of the wearer, an inner side portion 72*c* adapted to extend around the inner side of the wrist of a wearer, adjacent his or her thumb, and an opposite, outer side portion 72*d*. The portions 72*a*, 72*b*, 72*c*, 72*d* are shown as extending between transverse planes as indicated by lines. 74*a*, 74*b*, 74*c*, and 74*d*. Thus, the lower portion 72*a*, as shown, extends between planes 74*a* and 74*b*; the inner side portion extends between planes 74*b* and 74*c*. The upper portion extends between planes 74*c* and 74*d*; and the outer side portion 72*d* between planes 74*d* and 74*a*. It should be understood, however, that lines 74*a*, 74*b*, 74*c*, 74*d* are not intended to designate precise demarcations along the length of the bracelet 14 but instead are provided for illustrative purposes to permit convenient reference to the upper, lower, and side positions. In the preferred embodiment, the latching mechanism 46 is spaced, along the length of the bracelet 16, from the switch assembly 30 and push button member 62, whereby a user attempting to reach the push button 62 in an emergency is not confused by contact with the thumb screw element 48 and, conversely, wherein, a user attempting to unlock and release the bracelet 14 may readily grasp the thumb screw head 50 for unscrewing and opening the latch without the confusion or potential accidental actuation of the switch which could otherwise result if the push button switch were located adjacent the latching mechanism 50. In the present embodiment, the latching mechanism 46 is thus located in the inner side portion 72*c* of the bracelet 14, whereby a wearer may conveniently grasp the thumbscrew head portion 50 for engaging or disengaging the latching structure 48. In the preferred embodiment, the switching assembly 30, including push button 62, is mounted within the opposite portion of the bracelet 14, i.e., within the outer side portion 72*d*, whereby the push button 62 may be readily engaged by the wearer by grasping the bracelet, suitably with the thumb adjacent the inner side portion 72*c*, and with the palm of the hand extending over the outer portion 72*b*, whereby the middle finger is conveniently extended over the outer side portion 72*b* for conveniently depressing the push button 62 with the tip of the middle finger. As shown in FIG. 3, the location of the switch 30 and push button 62 is preferably within the lowermost region of the outer side segment 72*d*, i.e., adjacent to the underside of the wearer's wrist, whereby the push button 62 is normally hidden beneath the wrist of the wearer and is therefore not readily apparent to a casual observer.

Accordingly, as discussed above, the overall appearance of the transmitting unit 10 is that of a bracelet worn for ornamentation, and it is not readily apparent that it is a part of a security system. Nevertheless, the bracelet 14 is of rugged construction designed to protect the transmitting system 34 and also to prevent damage to or removal of the bracelet 14 in the event of an emergency or an assault. Because of the size and elliptical configuration of the bracelet 14, it tends to remain in its intended orientation on the wrist of the wearer, whereby the location of the pushbutton 62 on the wrist remains the same and whereby the switch 30 is always immediately available for convenient actuation by the wearer. As will be understood by those skilled in the art, because of the size of the bangle-style bracelet 14 and the adequate size of the interior cavity formed within the second segment 18, the transmitter/encoder unit 34, including the- battery 28 and antenna 32, may be of sufficient size and power for transmitting an encoded rf signal of substantial power which is sufficient to activate the receiving unit from a range of 100 feet or more, in the present embodiment. As will be understood by those in the art, the range and other characteristics of the transmitter 34 may be modified, as required for specific applications, by appropriate selection and arrangement of the electrical components, antenna size, battery voltage, and the like, in accordance with design principles well known to those skilled in the art.

Whereas the configuration of the transmitting unit 10 as shown in FIGS. 1–4 is preferred, it should be understood that, in other embodiments, the elements thereof may be rearranged, so long as the latch 46 is separated and spaced from the switch 30. For example, it may be preferred in some embodiments to incorporate the switch assembly 30 and push button 62 in the upper portion 72*b* of the bracelet 14, whereby it may be conveniently activated by a finger or thumb of the wearer. In other embodiments, it may be desired to incorporate the push button 62 in the inner side portion 72*c*, in which case the latch mechanism 46 is preferably in the outer portion 72*d*, and wherein the push button 62 is conveniently depressed by the thumb of the wearer. Further, wherein the transmitting unit 10 has thus far been described as a bangle-type bracelet, in other embodiments it is also suitably incorporated as a watch band, wherein a watch mechanism is mounted within the upper portion 72*b* of the bracelet 14. Further, wherein first and second rigid bracelet segments 16, 18 are employed in the preferred embodiment, in other embodiments the bracelet may be of flexible construction, as suggested above, in which case the hinge structure 20 would not be necessary. Such a flexible bracelet structure, not shown, is suitably formed of a single length of reinforced material of tubular configuration, divided to form mutually confronting distal end portions which are releasably connected by a security latching mechanism.

Referring to FIG. 5*a*, the transmitter/encoder system 34 includes power supply 28, which is suitably a 12-volt miniaturized dry cell of the type available from the Tandy Corporation as an RS 23-144 type battery. Referring additionally to FIG. 3, the battery 28 is removably seated within a recess extending between positive and negative terminals 78, 80 supported or formed within the second segment 18 (FIG. 3), the battery being constrained in place by compressed coil spring 82. Normally open switch 30 is connected between power supply 28 and the circuit boards 26*a*, 26*b*, which in the present embodiment constitute the encoder 26*a* and transmitter 26*b*. The output of transmitter 26*b* is connected to transmitting antenna 32 and is operable to transmit a high frequency signal, suitably in a range between 300 and 350 megahertz, when actuated by closure of the normally open switch 30.

As previously discussed, the alarm unit 84 may be installed in a home, automobile, business establishment, nurse's station, or in any other area in which it is desired to actuate a remotely located alarm. Referring to FIG. 5*b*, in the present embodiment, the alarm unit 84 includes a receiver and amplifier section 86 and a decoder unit 90 adapted to decode the encoded pulse transmitted by circuit 34. The receiver 86 suitably includes a preamplifier section for enhancing its sensitivity and usable range. The input of receiver 86 is connected to a receiving antenna 88 of a size and configuration appropriate for the particular frequency of the transmitter 26*b*. Suitably, the decoding section of receiver 86 is adjustable to correspond with a preselected code implemented by encoder 26*a*.

The response of the receiver 86 and decoder unit 90 to such an encoded rf signal is a positive DC signal, which switches a latch section 97, and includes a power switching transistor, such as a MOS-FET, connected between power supply 94 and an alarm device, such as a horn 96. The latch circuit 97 is adapted to remain closed following actuation until the circuit is reset by an operator. The transmitter and receiver units 34 and 84, as thus far described, are advantageously employed in applications in which the transmitted signal is desired to be an encoded signal, and in which a range of about 0–100 feet is required. One suitable commercially available transmitting and receiving and switching unit is that available from the Tandy Corporation of Fort Worth, Tex., as catalogue no. 61-2667. As will be understood by those skilled in the art, various modifications and alternative circuit embodiments may be employed in accordance with the requirements of a particular application. For example, the transmitting circuit may be modified as by using a power supply of higher voltage for greater transmitting power. Additionally, in some embodiments, it may not be necessary to employ an encoded signal, and various forms of signal modulation other than pulse modulation may be employed. In other applications, the alarm device 96 may be a siren, bell, or lamp. Alternatively, the receiving unit may be connected through telephone lines or a radio link to a remote security office, as in conventional silent alarm systems. The power supply for the receiving unit 84 may be derived from normal 115 AC power, or from a 12-volt battery in a vehicle, when the alarm unit is installed in a vehicle. As will be further understood by those skilled in the art, the components of the circuitry of the alarmunit 84 may be modified and, if desired, formed as one or more integrated circuit modules.

It will now be seen that the security alarm system 10 provides an effective means for quickly and conveniently initiating an alarm in the event of an emergency. The use of a transmitter enclosed within a bracelet adapted to be worn on the wrist and preferably having an ornamental appearance provides an efficient, portable actuating system which is conveniently employed to actuate the remote unit 34 at the first indication of an emergency. The construction of the bracelet, wherein the switch is spaced along the length of the bracelet from the latching mechanism, permits fail-safe operation of the switch. Moreover, the use of a push button switch recessed below the outer surface of the bracelet serves to prevent inadvertent actuation of the switch by the wearer yet permits the switch to remain continuously in a ready state, whereby the circuit need not be disabled by other switches or safety devices. Because the remote alarm unit is suitably permanently installed, as in a vehicle, residence, or the like, its size is not limited by considerations of portability, since it need not be carried upon the person of the user. Therefore, it may be of substantial power, sufficient to drive a powerful alarm device such as a large horn or bell. Nevertheless, the transmitting unit 10 is suitably of light-weight, conveniently portable construction.

Whereas only one embodiment of the system, together with modifications thereof, has been described in detail herein, and shown in the accompanying drawings, it will be evident that various further modifications are possible in the arrangement and construction of its components without departing from the scope of the invention.

What is claimed is:

1. A security alarm system comprising, in combination:

a bangle-type bracelet divided into first and second segments each having respective proximate end portions and means pivotally interconnecting the proximate end portions for permitting opening and closing of the bracelet segments, the bracelet segments having respective distal end portions, the bracelet further including security latching means having a threaded member movably coupled to the first bracelet segment, and means within the distal end portion of the second bracelet segment for receiving the threaded member along an axis extending transversely of the second bracelet segment;

the latching means including a fastening member having a threaded shaft and first receptacle means mounted in the distal end portion of one of the bracelet segments for threadingly receiving the fastening member shaft, the latching means further comprising second receptacle means mounted in the distal end portion of the other bracelet segment, for receiving the threaded shaft of the fastening member;

a transmitting assembly enclosed within one of said segments, the transmitting assembly having a power supply, a transmitter, and switching means electrically connected between the power supply and the transmitter, the switching means having an actuating member spaced from the latching means;

the first bracelet segment being intersected by an access opening and the switch actuating member including a push button mounted within the first bracelet segment adjacent the switching means, the push button being recessed inwardly relative to the outer surface of the first bracelet segment and being aligned with the access opening;

a resilient mounting member disposed between the switch actuating member and the first bracelet segment for yieldably maintaining the push button flush against the first bracelet segment in an open circuit switch position so that it may be depressed through the access opening to a closed circuit switch position, thus making the push button inconspicuous and further enhancing the illusion that the bracelet is merely an ornamental item rather than a security device; and, an alarm unit having an alarm device and a receiving system, responsive to signals emitted by the transmitting system for actuating the alarm device, and power supply means for powering the receiving system and the alarm device.

* * * * *